US009624943B2

(12) United States Patent
Jones et al.

(10) Patent No.: US 9,624,943 B2
(45) Date of Patent: Apr. 18, 2017

(54) SUPPRESSION OF BLADE PASSING FREQUENCY TONE IN AUTOMOTIVE AIR HANDLING SYSTEM

(71) Applicant: FORD GLOBAL TECHNOLOGIES, LLC, Dearborn, MI (US)

(72) Inventors: Curtis M. Jones, Wixom, MI (US); Zhengyu Liu, Novi, MI (US); John Azar, LaSalle, CA (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 601 days.

(21) Appl. No.: 14/150,036

(22) Filed: Jan. 8, 2014

(65) Prior Publication Data

US 2015/0192131 A1 Jul. 9, 2015

(51) Int. Cl.
*F04D 17/10* (2006.01)
*F04D 29/42* (2006.01)

(52) U.S. Cl.
CPC ..... *F04D 29/4213* (2013.01)

(58) Field of Classification Search
CPC ..... F04D 29/4213; F04D 29/4226; F04D 29/661; F04D 29/667; F04D 29/4233; F04D 29/422
See application file for complete search history.

(56) References Cited

U.S. PATENT DOCUMENTS 2,001,522 A 5/1935 Chester
5,813,831 A 9/1998 Matsunaga et al.
6,386,966 B1 5/2002 Kuwayama et al.
6,964,555 B2 11/2005 Ochiai et al.
7,175,398 B2 2/2007 Kinmartin et al.
7,186,080 B2 3/2007 Smiley, III et al.
7,381,028 B2 * 6/2008 Hancock ..... F04D 17/02 29/888.022
7,431,558 B2 * 10/2008 Krempel ..... F04D 29/4213 415/102
7,883,312 B2 * 2/2011 Eguchi ..... F04D 29/162 415/119
7,909,571 B2 * 3/2011 Wu ..... F04D 29/4213 415/206

(Continued)

FOREIGN PATENT DOCUMENTS

KR 20060117012 A * 11/2006
KR 20060118726 A * 11/2006

*Primary Examiner* — Justin Seabe
(74) *Attorney, Agent, or Firm* — Vichit Chea; MacMillan, Sobanski & Todd, LLC

(57) ABSTRACT

A noise tone occurring at a blade passing frequency in a blower for an automotive HVAC system is suppressed. The blower includes a centrifugal fan and a scroll body disposed around the fan. An outlet extends from the scroll body to conduct an air flow from a cutoff point of the scroll body. An inlet is coupled to the scroll body defining an inlet throat comprising an arcuate ring extending between a base and an annular end coaxially disposed over the fan. A partial-perimeter wall extends upstream from the arcuate ring having a height between about 4% and about 6.5% of an inner diameter of the annular end. The wall spans a perimeter portion of the circumference of the throat between about 120° and about 180°. As a result, noise at the blade passing frequency is suppressed without any significant reduction in air flow.

15 Claims, 8 Drawing Sheets

(56) References Cited

U.S. PATENT DOCUMENTS

| | | | | |
|---|---|---|---|---|
| 8,075,262 | B2 | 12/2011 | Watanabe et al. | |
| 8,123,468 | B2 * | 2/2012 | Shirahama ..... | F04D 29/4213 415/119 |
| 8,231,331 | B2 | 7/2012 | Wu | |
| 2007/0041831 | A1 | 2/2007 | Bartlett | |
| 2010/0215486 | A1 | 8/2010 | Shirahama | |
| 2011/0033287 | A1 | 2/2011 | Lindner et al. | |

* cited by examiner

SUPPRESSION OF BLADE PASSING FREQUENCY TONE IN AUTOMOTIVE AIR HANDLING SYSTEM

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to a blower element of a heating, ventilating, air conditioning (HVAC) system for automobiles, and, more specifically, to blower inlet structures that reduce tonal noise generation without reducing the quantity of air flow.

In a typical automotive HVAC system, a blower delivers fresh or recirculated air to heat exchangers (e.g., an evaporator or a heater core) which is then distributed to the passenger cabin via ducts and outlet registers. The blower includes a housing that contains a fan (i.e., impeller) and a motor for rotating the fan. One of the most common configurations for an automotive HVAC air handling system uses a centrifugal blower, wherein a cylindrical arrangement of fan blades receives inlet air via an axial opening in the housing and centrifugally accelerates the air through a surrounding scroll region to an outlet. The scroll region has a volute shape in which the cross-sectional area of the scroll increases as the outlet is approached.

A centrifugal impeller typically is formed as a rotating blower wheel having a plurality of cylindrically-placed fan blades. An inlet arranged over one side of the blower wheel has a throat with an inside diameter slightly less that the inside diameter between the fan blades so that air is directed to the inside axis of the blower wheel to be accelerated into the outer scroll region. The throat is usually ring-shaped having an inward arc and/or other features to create a venturi effect that increases air flow into the blower.

The typical throat arrangement tends to induce a strong air flow interaction with the moving blades near the ring. The interaction generates an audible tone occurring at a fundamental frequency determined by the number of fan blades multiplied by the speed of rotation, referred to as the Blade Passing Frequency (BPF). The BPF tone usually sounds like a high-pitched whistle. This noise can become objectionable to occupants of the vehicle.

SUMMARY OF THE INVENTION

In one aspect of the invention, a blower for an automotive HVAC system includes a centrifugal fan and a scroll body disposed around the fan. An outlet extends from the scroll body to conduct an air flow from a cutoff point of the scroll body. An inlet is coupled to the scroll body defining an inlet throat comprising an arcuate ring extending between a base and an annular end coaxially disposed over the fan. A partial-perimeter wall extends upstream from the arcuate ring having a height between about 4% and about 6.5% of an inner diameter of the annular end. The wall spans a perimeter portion of the circumference of the throat between about 120° and about 180°.

DETAILED DESCRIPTION OF PREFERRED EMBODIMENTS

Figure 1:
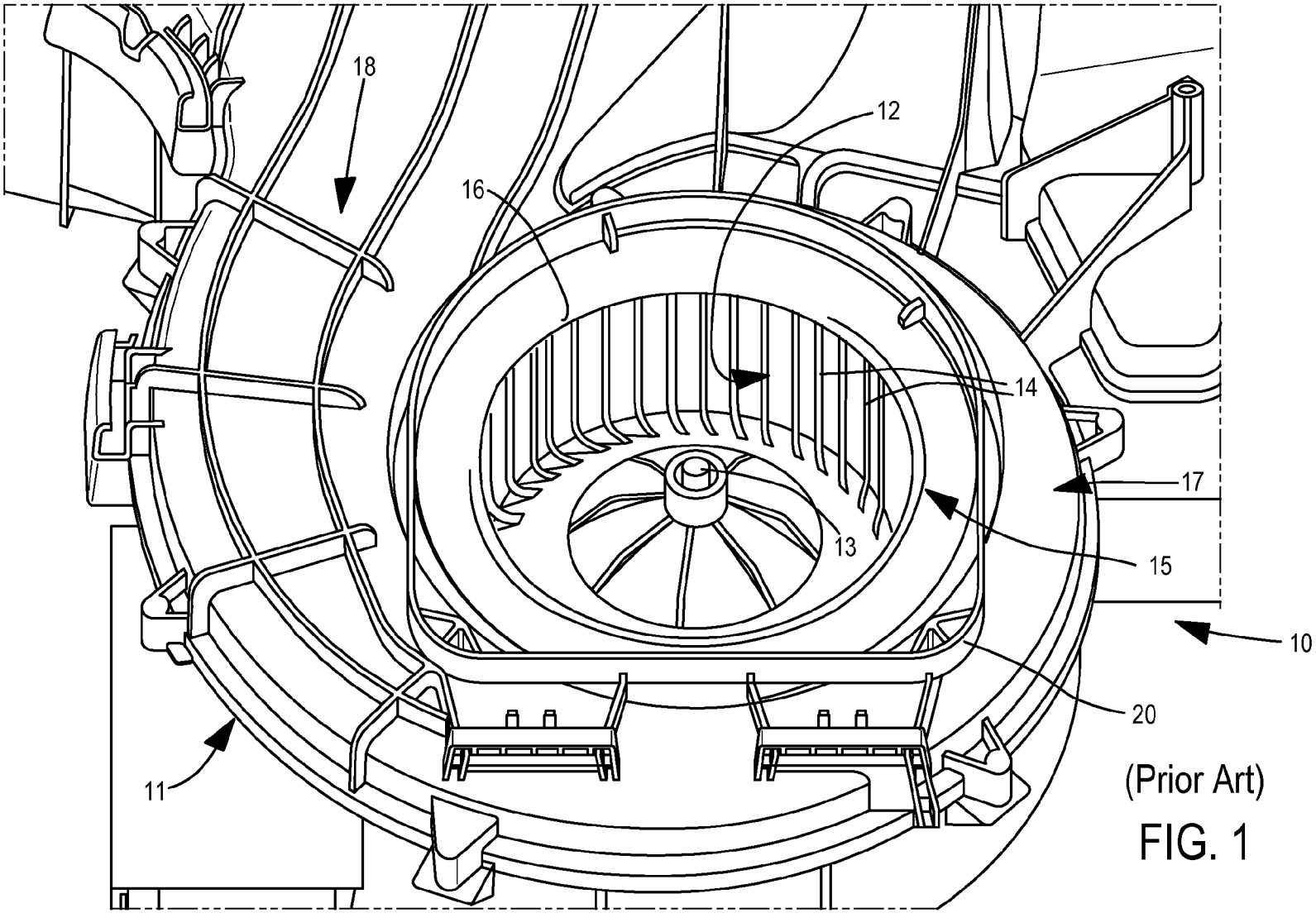
(Prior Art) FIG. 1
FIG. 1 is a perspective view of a prior art blower.
Figure 2:
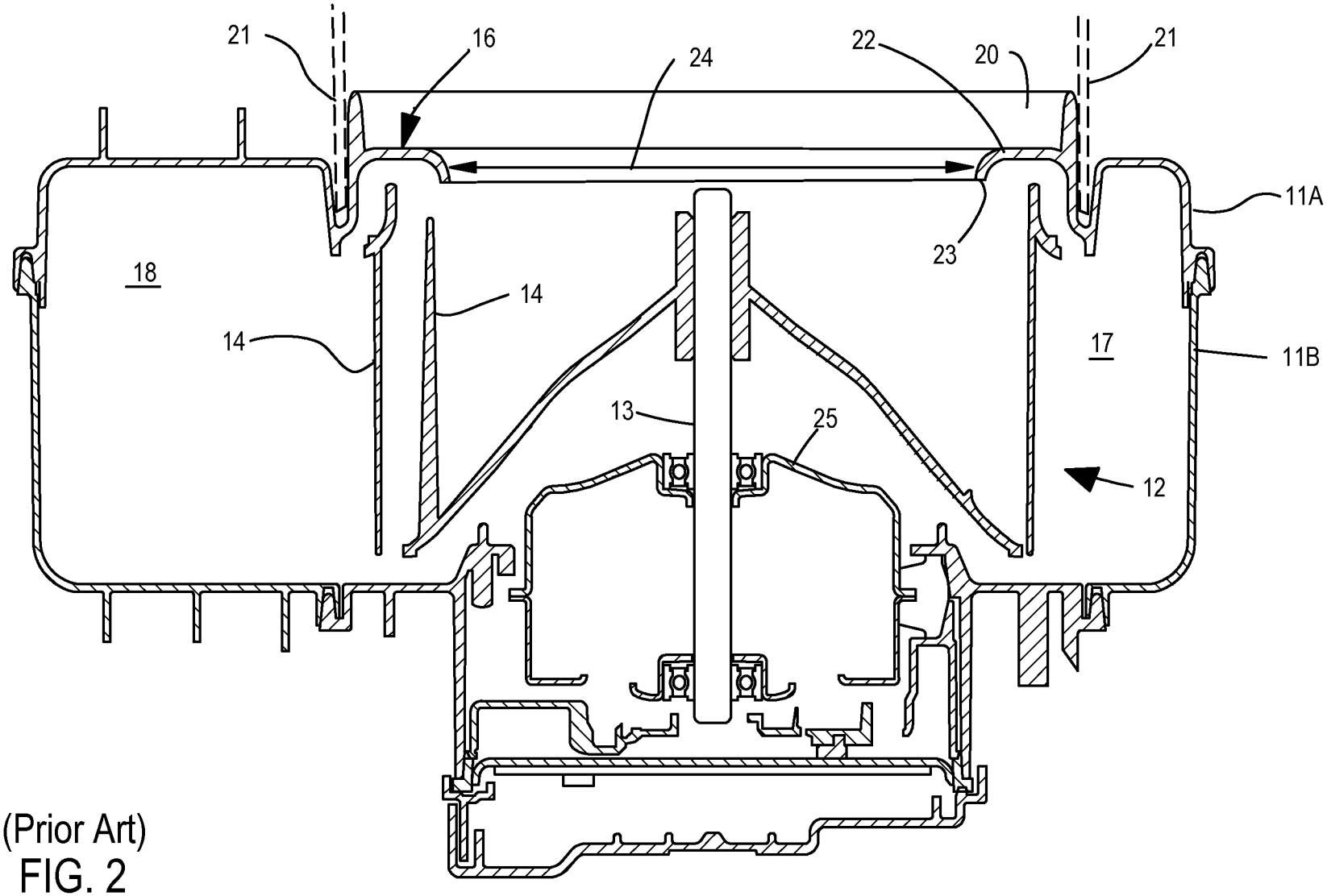
(Prior Art) FIG. 2
FIG. 2 is a cross section of the blower of FIG. 1.

Referring now to FIG. 1, a conventional blower 10 for an automotive HVAC system includes a case or housing 11 formed of a molded thermoplastic typically in upper and lower halves that are assembled to contain a blower or fan wheel 12 in an internal cavity which is connected to a motor shaft 13 allowing a motor to rotate fan wheel 12 at a variable speed. As shown in FIG. 2, housing 11 typically employs an upper half 11A and a lower half 11B, which are separately injection molded and then assembled after installing fan wheel 12 and a motor 25. Fan wheel 12 is made up of individual fan blades 14 arranged cylindrically around a central axis which coincides with shaft 13. Housing 11 includes an inlet 15 with a throat 16 formed as an arcuate ring coaxially disposed over fan blades 14. Housing 11 has a scroll region 17 around its perimeter with an increasing radius while moving rotationally toward an outlet region 18 of housing 11. A flange 20 is disposed around throat 16 to provide for the attachment of an inlet duct supplying fresh and/or recirculated air as known in the art. When inlet air is received and it moves within throat 16, BPF noise is generated which can propagate to the vehicle passenger compartment as an objectionable noise.

The cross-section of FIG. 2 indicates in phantom the placement of an inlet duct 21 over flange 20. Throat 16 has an arcuate ring that extends between a base portion 22 and an annular end 23. Annular end 23 defines an inner diameter 24. The arcuate shape of throat 16 enables a large volume of air to easily flow into housing 11. As the air moves down stream into the interior of fan wheel 12 inside blades 14, interaction with blades 14 creates the BPF noise.

Figure 3:
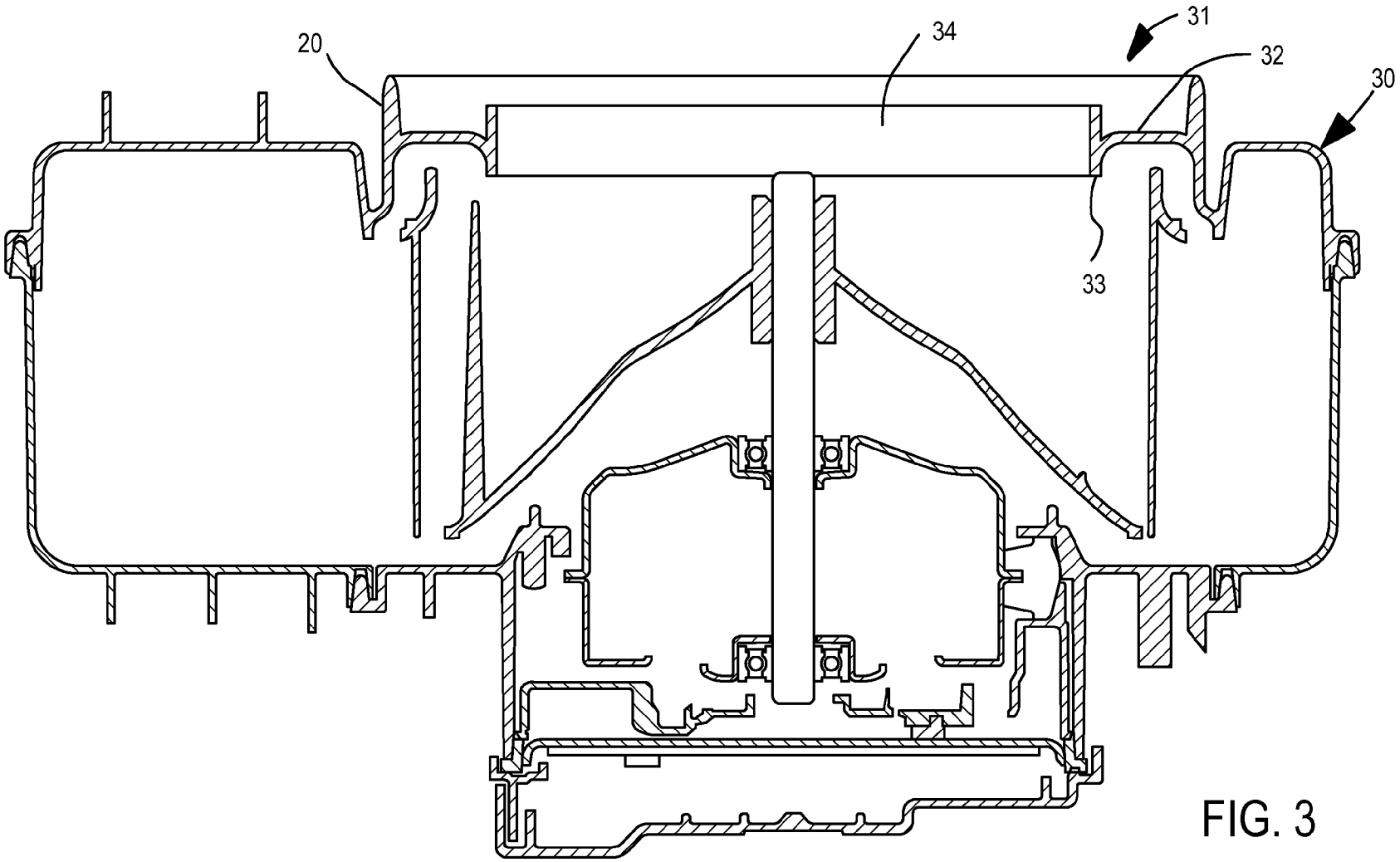
FIG. 3 is a cross section showing a first modification of the blower of FIG. 1 to reduce a BPF noise.

It has been found that the BPF noise can be addressed using a vertical ring wall attached to the perimeter of the throat to modify the inlet air flow pattern. As shown in FIG. 3, a housing 30 has an inlet 31 which includes an inlet throat 32 with an arcuate shape and having an annular end 33 similar to the embodiment shown in FIGS. 1 and 2. In addition, throat 32 includes an upstanding perimeter wall 34 projecting in an upstream direction from annular end 33. Wall 34 is substantially cylindrically shaped so that it is parallel to the air flow. Although it has been discovered that the presence of wall 34 suppresses the BPF tone, it simultaneously reduces total air flow by up to about 3%. The reduced air flow may degrade air conditioning pull-down performance, for example.

Figure 4:
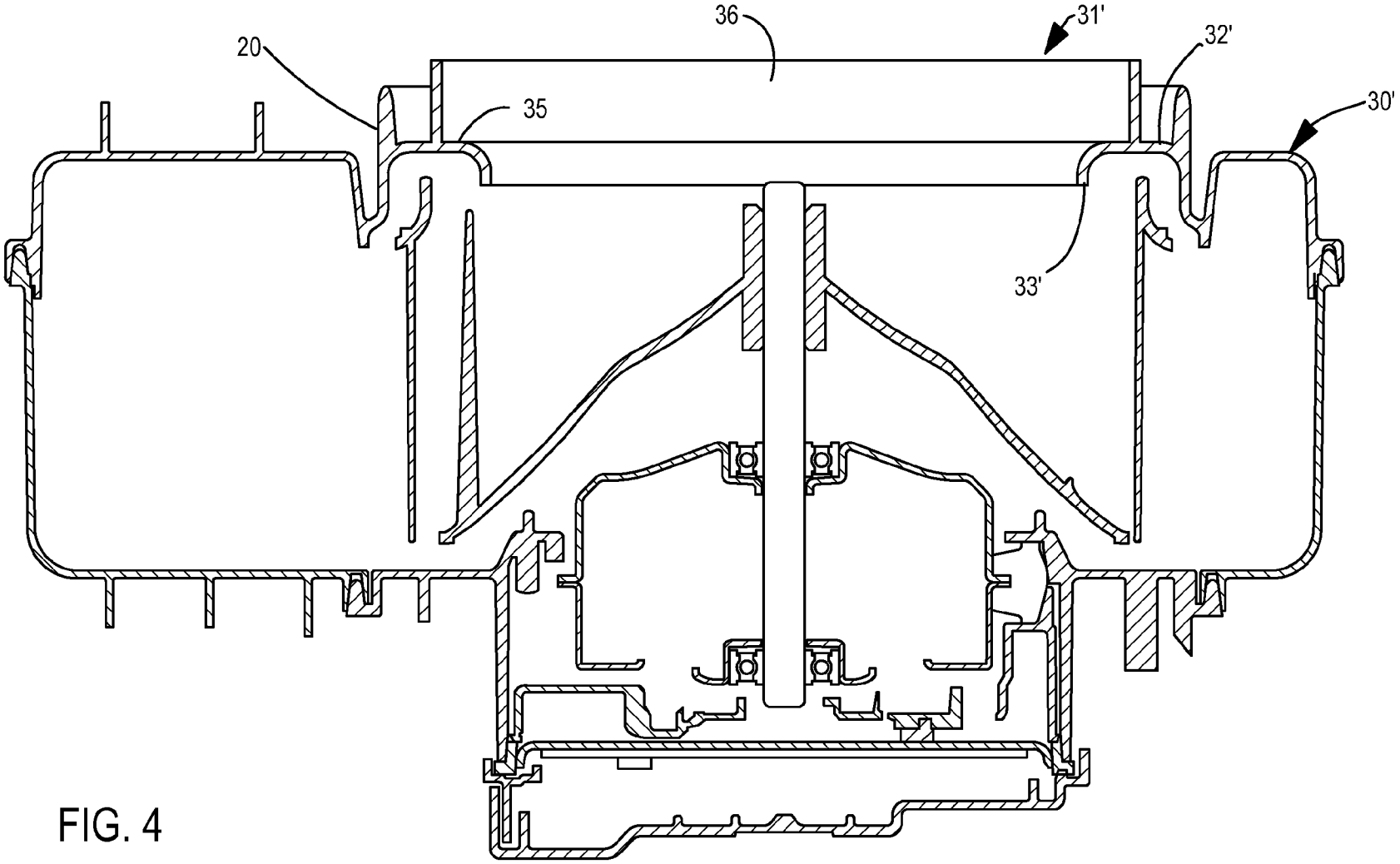
FIG. 4 is a cross section showing a second modification of the blower of FIG. 1 to reduce a BPF noise.

The BPF tone can also be suppressed with the perimeter wall being located at other than the extreme annular end of the throat. As shown in FIG. 4, a modified housing 30' has an inlet 31' with an inlet throat 32'. The arcuate shape of throat 32' extends between annular end 33' and a base 35. In this embodiment, a perimeter wall 36 extends in an upstream direction from base 35. Although the BPF tone is reduced, overall air flow may still be reduced up to as much as 3%.

Figure 5:
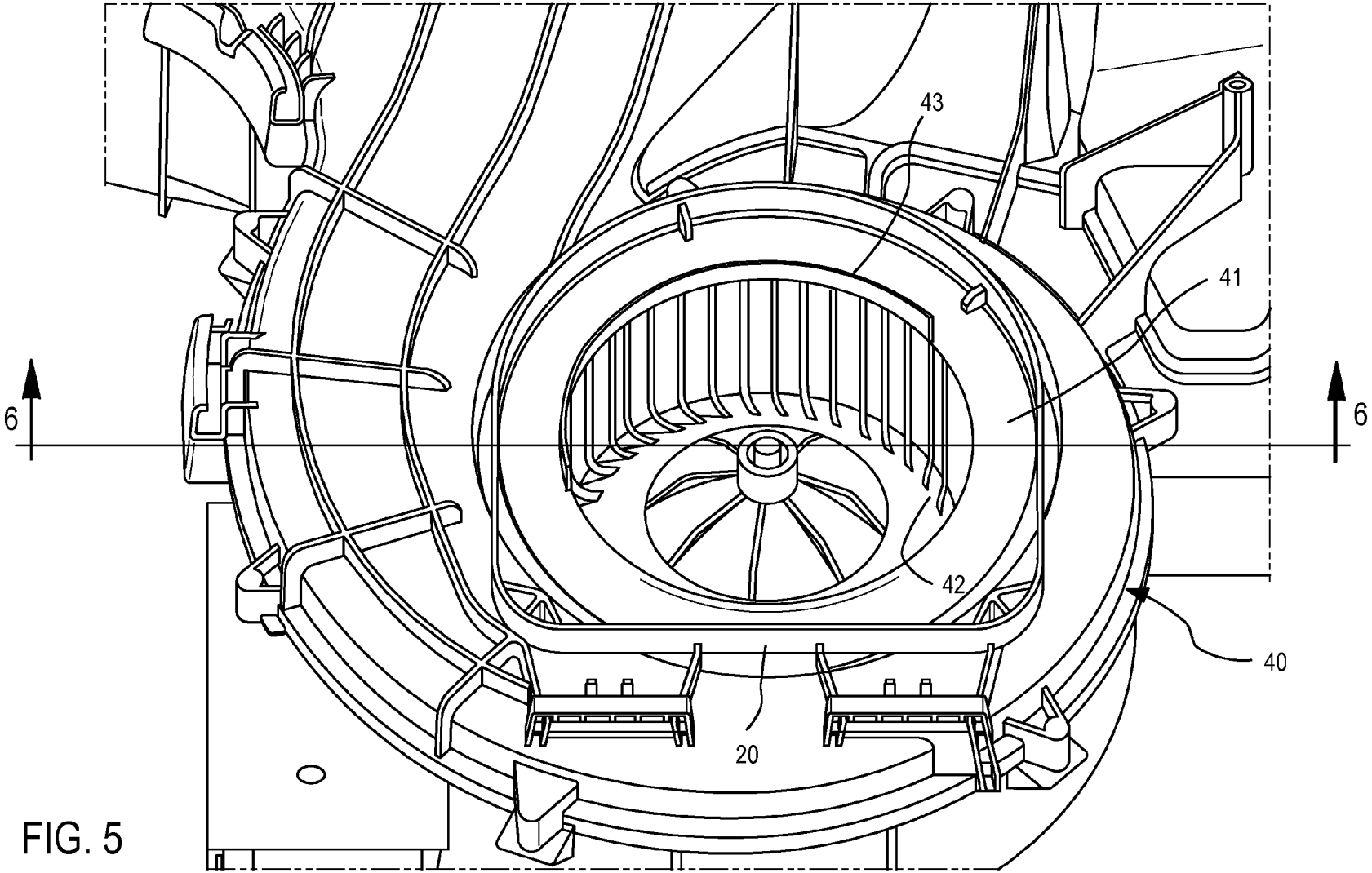
FIG. 5 is a perspective view of an embodiment of the present invention which reduces a BPF noise without any substantial decrease in air flow as experienced in the embodiments of FIGS. 3 and 4.
Figure 6:
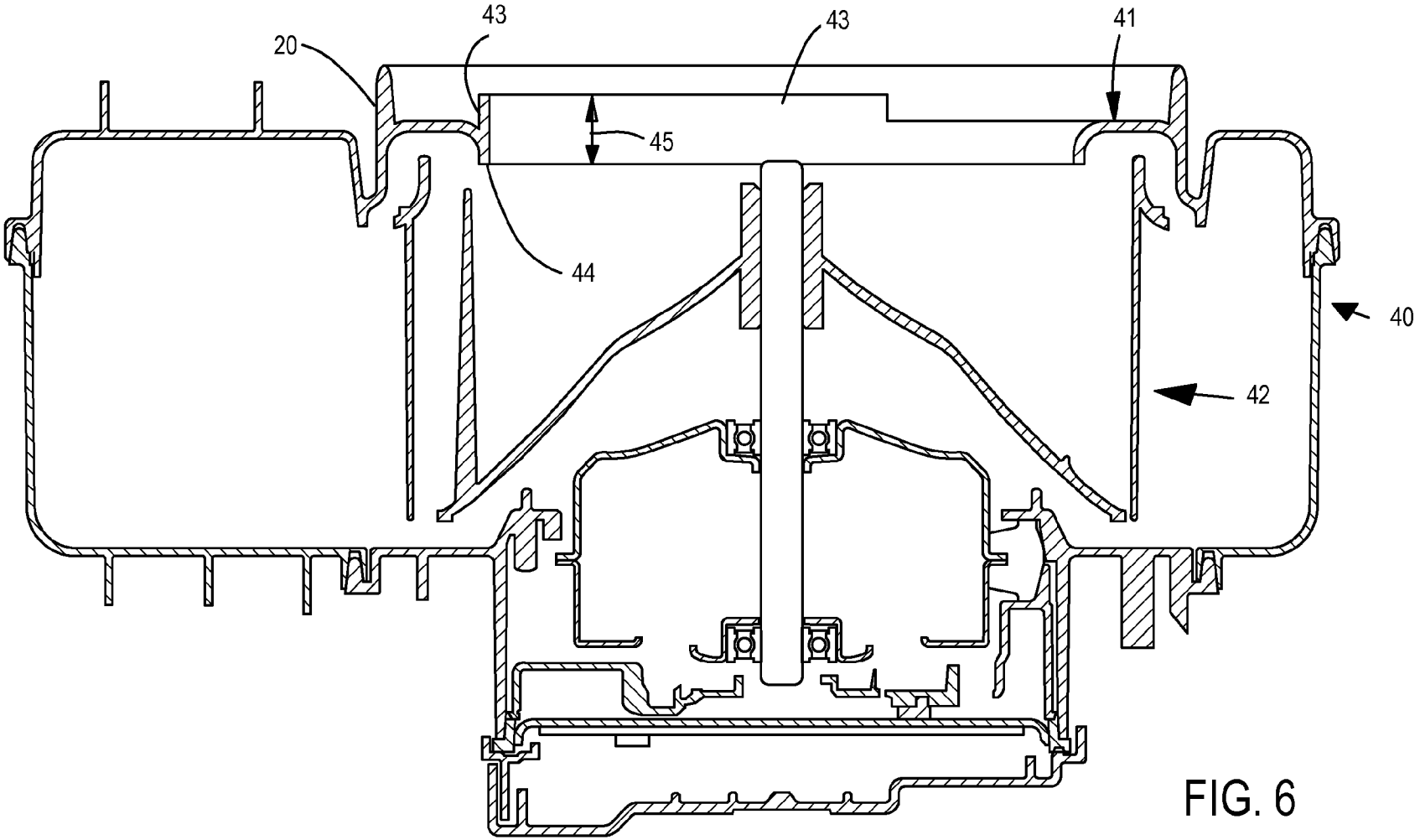
FIG. 6 is a cross section of the blower of FIG. 5.

In order to suppress the BPF tone while avoiding substantial reduction in total air flow through the inlet, the present invention utilizes a partial-perimeter wall as shown in FIG. 5. Thus, a housing 40 includes an inlet throat 41 comprising an arcuate ring extending between a base and an annular end coaxially disposed over a centrifugal fan 42 as in the previous embodiments. In addition, a partial-perimeter wall 43 extends in an upstream direction from inlet throat 41. As seen in the cross-sectional view in FIG. 6, partial-perimeter wall 43 may preferably extend upstream (i.e., vertical in FIG. 6) from annular end 44 of throat 41. Wall 43 has a height 45 which is equal to between about 4% and about 6.5% of the inner diameter across throat 41 at annular end 44. Partial-perimeter wall 43 is preferably molded to have about the same thickness as throat 41 as well as the majority of the wall surfaces of housing 40 (which are all preferably integrally molded). Although partial-perimeter wall 43 does not extend around the full perimeter, the BPF town is still greatly suppressed. Meanwhile, almost no reduction of total air flow is produced.

Figure 7:
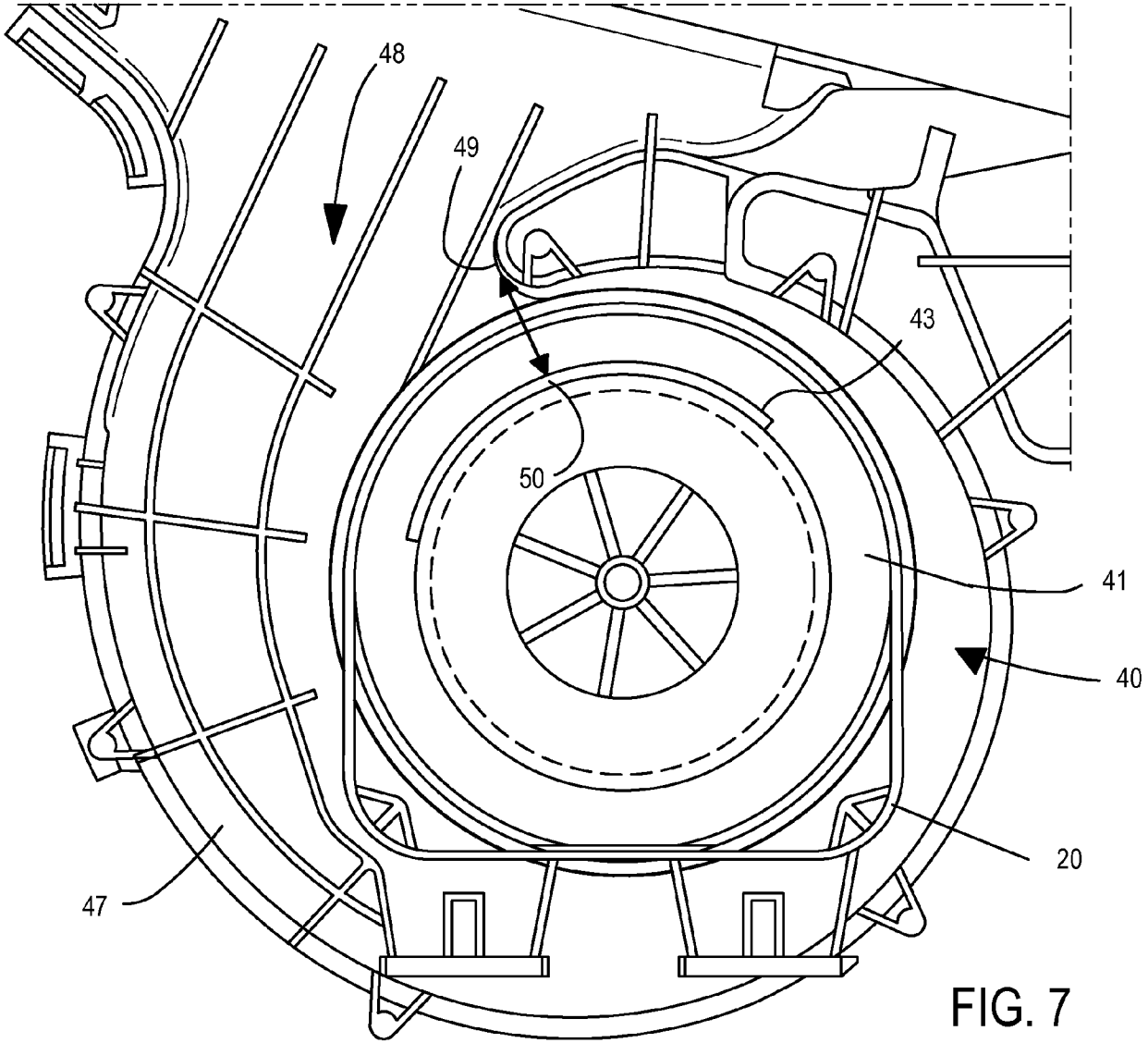
FIG. 7 is a top plan view of the blower of FIG. 5 showing a relative position of a partial-perimeter wall to a scroll cutoff point.

As shown in FIG. 7, the positioning of the wall along the perimeter of the throat has an optimum location for reducing the BPF tone. Inlet 40 defines a scroll region 47 with an outlet 48 defined as one side by a scroll cutoff point 49. Partial-perimeter wall 43 preferably spans a perimeter portion of the circumference of throat 41 corresponding to between about 120° and about 180°. Moreover, wall 43 has a circumferential center or midpoint 50 which is radially aligned with cutoff point 49. Thus, wall 43 minimizes interaction of the incoming airflow with the fan blades centered at the region where the transition occurs in the scroll region between the outlet and the start of the scroll region.

Figure 8:
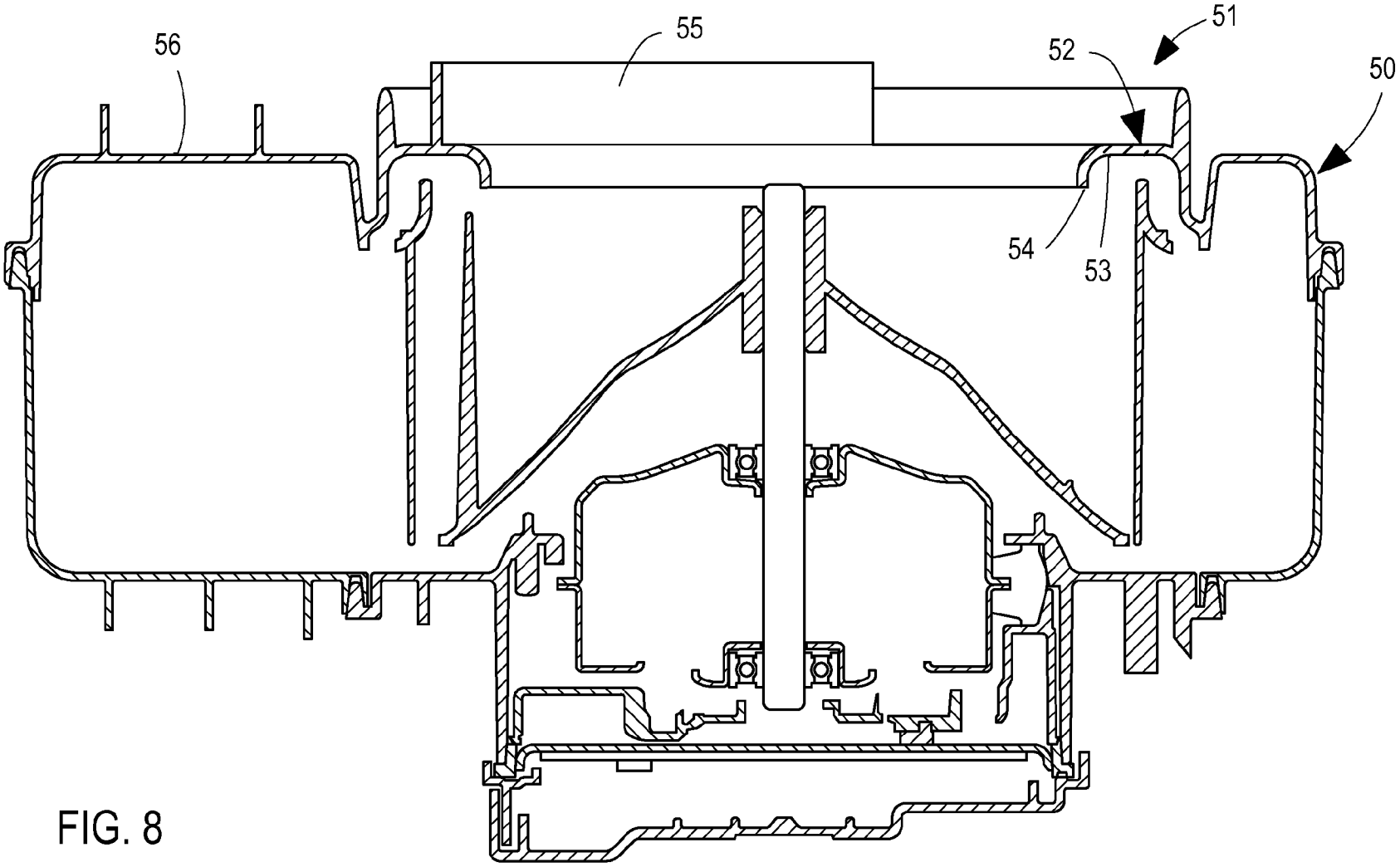
FIG. 8 is a cross-sectional view of another embodiment of a partial-perimeter wall.

The partial-perimeter wall can be located at a position other than the annular end. As shown in FIG. 8, a housing 50 has an inlet 51 including a throat 52 arcuately shaped between a base 53 and an annular end 54. A partial perimeter wall 55 extends upstream from base 53 likewise having a height between about 4% and about 6.5% of an inner diameter of throat 52 at annular end 54. Likewise, wall 55 spans a perimeter portion of the circumference of throat 52 between about 120° and about 180°. Preferably, wall 53 likewise has a circumferential center substantially aligned with the cutoff point of an outlet 56 of housing 50.

The present invention has provided an air handling case for an automotive HVAC system in which a scroll body is disposed around a cavity for a centrifugal fan thereby providing an outlet to conduct an air flow from a cutoff point of the scroll body. An inlet throat formed as an arcuate ring extending between a base and an annular end includes a partial-perimeter wall which extends upstream from the arcuate ring. As a result of the wall spanning only a perimeter portion of the circumference of the arcuate ring between about 120° and about 180°, the BPF tone can be suppressed without substantially reducing air flow through the inlet throat.

What is claimed is:

1. A blower for an automotive HVAC system comprising:
- a centrifugal fan;
- a scroll body disposed around the fan;
- an outlet extending from the scroll body to conduct an air flow from a cutoff point of the scroll body;
- an inlet coupled to the scroll body defining an inlet throat comprising an arcuate ring extending between a base and an annular end coaxially disposed over the fan; and
- a partial-perimeter wall extending upstream from the arcuate ring having a height between about 4% and about 6.5% of an inner diameter of the annular end, wherein the partial-perimeter wall spans a perimeter portion of the circumference of the throat and is between about 120° and about 180° in length, wherein the partial-perimeter wall has a circumferential center radially aligned with the cutoff point.

2. The blower of claim 1 wherein the partial-perimeter wall projects from the annular end.

3. The blower of claim 1 wherein the partial-perimeter wall projects from the base.

4. The blower of claim 1 wherein the partial-perimeter wall has a thickness substantially the same as a thickness of the arcuate ring.

5. The blower of claim 1 wherein the inlet, partial-perimeter wall, and at least a portion of the scroll body are integrally molded of a thermoplastic resin.

6. An air handling case comprising:
- a scroll body disposed around a cavity for a fan;
- an outlet to conduct an air flow from a cutoff point of the scroll body;
- an inlet formed as an arcuate ring extending between a base and an annular end; and
- a partial-perimeter wall extending upstream from the arcuate ring wherein the wall spans a perimeter portion of the circumference of the arcuate ring and is between about 120° and about 180° in length, wherein the partial-perimeter wall has a circumferential center radially aligned with the cutoff point.

7. The case of claim 6 wherein the partial-perimeter wall has a height between about 4% and about 6.5% of an inner diameter of the annular end.

8. The case of claim 6 wherein the partial-perimeter wall projects from the annular end.

9. The case of claim 6 wherein the partial-perimeter wall projects from the base.

10. The case of claim 6 wherein the partial-perimeter wall has a thickness substantially the same as a thickness of the arcuate ring, and wherein the inlet, partial-perimeter wall, and at least a portion of the scroll body and the outlet are integrally molded of a thermoplastic resin.

11. An air handling case comprising:
- a scroll body disposed around a fan cavity;
- an outlet to conduct an air flow from a cutoff point of the scroll body;
- an inlet formed as an arcuate ring extending between a base and an annular end;
- a partial-perimeter wall extending upstream from the inlet spanning a perimeter portion of the circumference of the arcuate ring and has a circumferential center radially aligned with the cutoff point.

12. The case of claim 11 wherein the partial-perimeter wall has a height between about 4% and about 6.5% of an inner diameter of the annular end.

13. The case of claim 11 wherein the partial-perimeter wall is between about 120° and about 180° in length.

14. The case of claim 11 wherein the partial-perimeter wall projects from the annular end.

15. The case of claim 11 wherein the partial-perimeter wall has a thickness substantially the same as a thickness of the arcuate ring, and wherein the inlet, partial-perimeter wall, and at least a portion of the scroll body and the outlet are integrally molded of a thermoplastic resin.

* * * * *